United States Patent [19]

Hisashige et al.

[11] Patent Number: 5,025,890

[45] Date of Patent: Jun. 25, 1991

[54] ENGINE EXHAUST APPARATUS

[75] Inventors: Nobuyasu Hisashige; Fukuichi Yokogawa; Makoto Shinhama, all of Hiroshima, Japan

[73] Assignee: Mazda Motor Corporation, Hiroshima, Japan

[21] Appl. No.: 483,230

[22] Filed: Feb. 23, 1990

[30] Foreign Application Priority Data

Feb. 23, 1989 [JP] Japan ..... 1-20778

[51] Int. Cl.[5] ..... F01N 1/02; F01N 1/10

[52] U.S. Cl. ..... 181/272; 181/256; 181/265; 181/266

[58] Field of Search ..... 181/256, 265, 266, 272

[56] References Cited

U.S. PATENT DOCUMENTS

| | | | |
|---|---|---|---|
| 3,771,315 | 11/1973 | Scott | 181/265 X |
| 4,192,401 | 3/1980 | Deaver et al. | 181/266 |
| 4,393,956 | 7/1983 | Tsukui et al. | 181/265 |
| 4,580,656 | 4/1986 | Fukuda | 181/265 X |
| 4,589,517 | 5/1986 | Fukuda | 181/265 |
| 4,637,491 | 1/1987 | Fukuda | 181/265 |

*Primary Examiner*—Benjamin R. Fuller

*Attorney, Agent, or Firm*—Fleit, Jacobson, Cohn, Price, Holman & Stern

[57] ABSTRACT

An engine exhaust including a silencer which has a cylindrical shell, a front and a rear end plate which are provided to close both ends of the cylindrical shell, and at least three partition walls to divide an inside space of the silencer into a plurality of chambers, i.e. at least a first chamber, a second chamber, a third chamber and a fourth chamber. An inlet pipe which bypasses at least the first and the second chambers, and connects the front end and the third chamber. The inlet pipe has a plurality of small holes which face toward the first and the second chambers. The small holes facing the second chamber are surrounded by a sound absorber. An outlet pipe bypasses at least the second, the third and the fourth chambers and connects the first chamber and the rear end plate. The outlet pipe has a plurality of small holes which face toward the third and the fourth chambers. The small holes facing the fourth chamber are surrounded by a sound absorber.

25 Claims, 10 Drawing Sheets

ENGINE EXHAUST APPARATUS

BACKGROUND OF THE INVENTION

1. Field of the Invention

The present invention relates to an engine exhaust apparatus haVing a muffler or a silencer which eliminates exhaust gas noises.

2. Description of the Prior Art

In order to reduce sounds of exhaust gases from an engine, a muffler or a silencer is connected to an exhaust passageway. The sounds or noises of exhaust gases generated from the engine are generally known to be reduced by passage of the exhaust gases through a plurality of small holes of an elimination chamber so that the gases interact to lower their sound level. Such a principle has been used as shown, for example, in Japanese Utility Model Laid-open application Ser. No. 62-90916.

On the other hand, in Japanese Utility Model Laid-open application Ser. No. 60-128925, there is disclosed a muffler which has a front expansion chamber and a rear expansion chamber. The front end of the muffler and the rear expansion chamber are connected by an inlet pipe bypassing the front expansion chamber and the rear end of the muffler and the front expansion chamber are connected by an outlet pipe bypassing the rear expansion chamber. Further, there are provided a plurality of small holes in the inlet pipe at the portion which faces the front expansion chamber and a plurality of small holes in the outlet pipe at the portion which faces the rear expansion chamber.

In such a muffler, exhaust gases introduced into the inlet pipe are expanded by partly entering into the front expansion chamber through the plurality of small holes in the inlet pipe and partly entering into the rear expansion chamber from the rear end of the inlet pipe. Then, exhaust gases in the front expansion chamber are emitted to the outside through the outlet pipe and exhaust gases in the rear expansion chamber are delivered into the outlet pipe through the plurality of small holes in the outlet pipe and then emitted to the outside through the outlet pipe.

According to the above described muffler, since the outlet pipe has a plurality of small holes, the sound of exhaust gases delivered from the front expansion chamber into the outlet pipe and the sound of exhaust -gases delivered from the rear expansion chamber into the outlet pipe through the plurality of small holes interact properly to suppress noise so as to lower resonance phenomenon in the outlet pipe. The length of pipe can thereby be shortened.

Furthermore, Japanese Utility Model Laid-open application Ser. No. 60-92715 discloses a silencer which has a sound absorber surrounding a pipe with a plurality of small holes therein in order to suppress high frequency sounds. However, the above-described silencers have no structural features to positively create comfortable or sporty sounds as well as to suppress the magnitude of exhaust sounds by combining well-known elements such as a pipe having a plurality of small holes or a sound absorber.

SUMMARY OF THE INVENTION

Therefore, an object of the present invention is to provide an engine exhaust apparatus capable of lowering the magnitude of exhaust sounds and noises especially in a high frequency region.

Also, another object of the present invention is to provide an engine exhaust apparatus capable of creating non-offensive, comfortable sounds or sporty sounds, especially in a low or intermediate frequency region.

This invention is accomplished by providing an engine exhaust apparatus comprising a silencer which has a cylindrical shell, a front and a rear end plate which are provided to close both ends of the cylindrical shell, and at least three partition walls to divide an inside space of the silencer into a plurality of chambers, i.e. at least a first chamber, a second chamber, a third chamber and a fourth chamber. Further there is provided an inlet pipe which bypasses at least the first and the second chambers, and connects the front end and the third chamber. The inlet pipe has a plurality of small holes which face toward the first and the second chambers. The small holes facing the second chamber are surrounded by a sound absorber. There is provided an outlet pipe which bypasses at least the second, the third and the fourth chambers and connects the first chamber and the rear end plate. The outlet pipe has a plurality of small holes which face toward the third and the fourth chambers. The small holes facing the fourth chamber are surrounded by a sound absorber.

The above and other objects and features of the present invention will become apparent from the following description of a preferred embodiment with reference to the accompanying drawings.

BRIEF DESCRIPTION OF THE DRAWINGS

FIG. 2-A is an alternate location, on an enlarged scale, of the exhaust pipes of the silencer which is shown in FIG. 2;

FIG. 11-A is an alternate location, on an enlarged scale, of the exhaust pipes of the silencer which is shown in FIG. 11;

DETAIL DESCRIPTION OF PREFERRED EMBODIMENTS OF THE INVENTION

Figure 1:
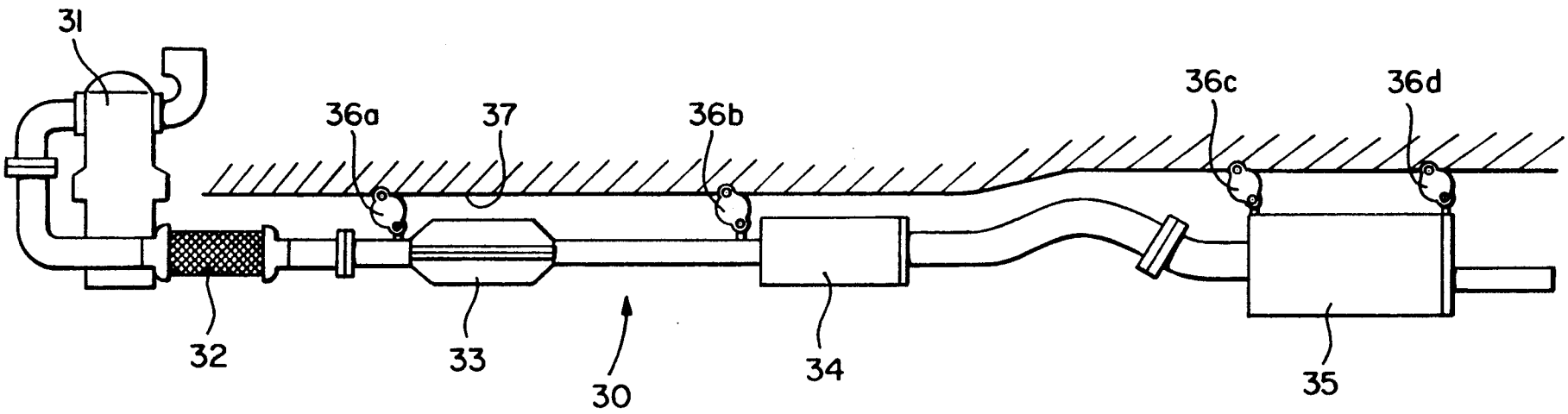
FIG. 1 is a schematic view showing an outline of one example of the engine exhaust apparatus in accordance with the present invention.

Referring to FIG. 1, an exhaust system 30 is connected with an engine 31. The exhaust system is composed of a series of devices from upstream to downstream, i.e. a flexible tube 32, a catalyst converter 33, a sub-silencer 34 and a main silencer 35. The exhaust system is supported to a vehicle body 37 by means of a plurality of hanger rubbers 36*a*, 36*b*, 36*c* and 36*d*.

Figure 2:
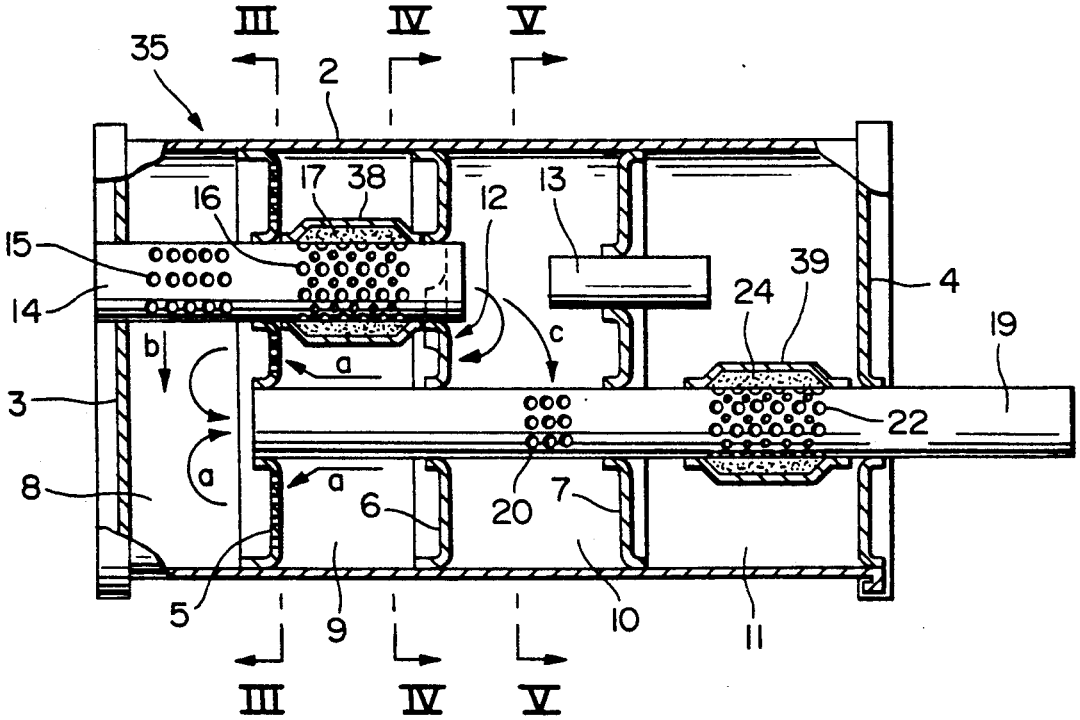
FIG. 2 is a sectional view showing an interior structure of a silencer which is shown in the FIG. 1.
Figure 2A:
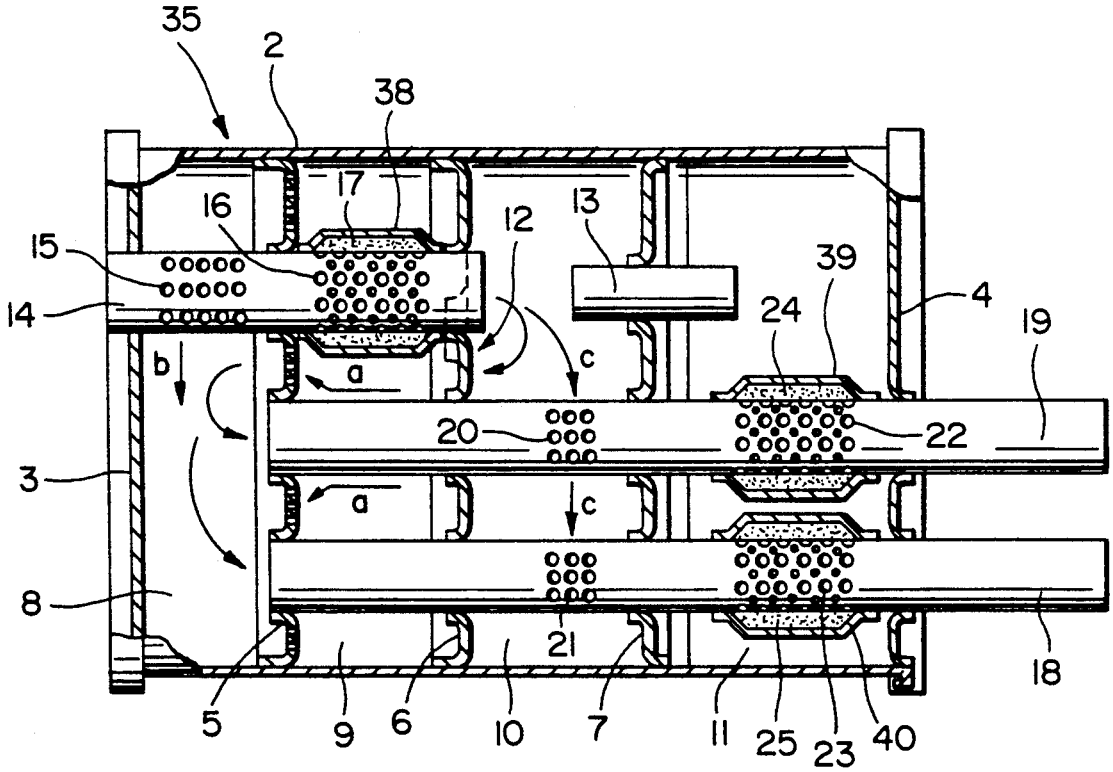
Figure 5:
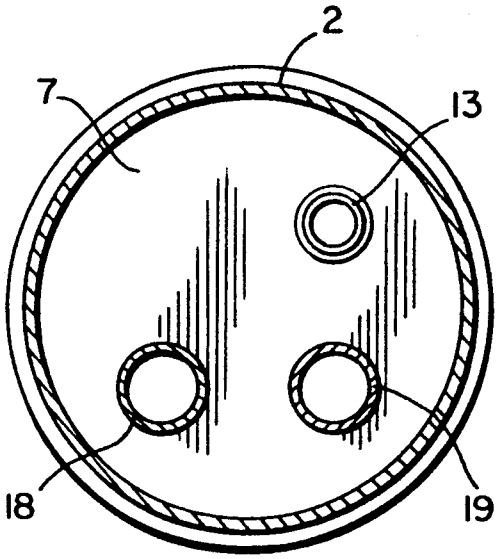
FIG. 5 is a cross-sectional view taken along line V—V in FIG. 2.
Figure 4:
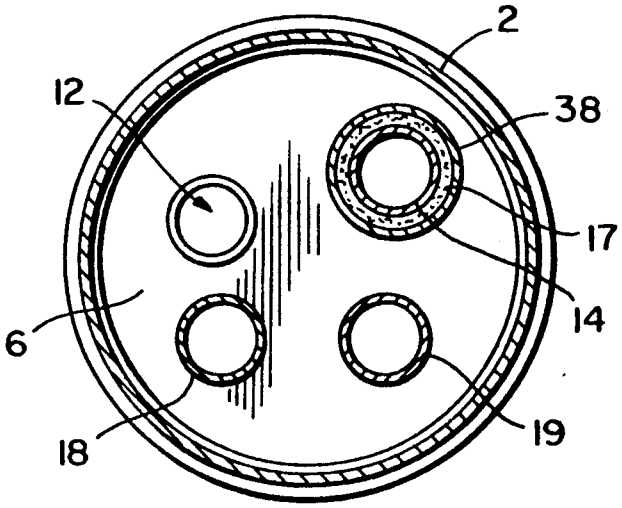
FIG. 4 is a cross-sectional view taken along line IV—IV in FIG. 2.
Figure 3:
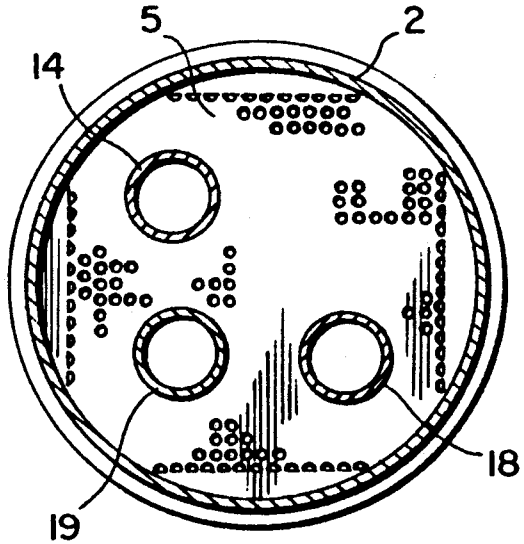
FIG. 3 is a cross-sectional view taken along line III—III in FIG. 2.

The main silencer 35 has a chamber defined by a cylindrical shell 2 and end plates 3, 4, as shown in FIG. 2. The volume of the chamber is 11.6 liters. The inside of the chamber is divided into four small chambers, a first chamber 8, a second chamber 9, a third chamber 10 and a fourth chamber 11 by three partition walls 5, 6 and 7. The first chamber 8 functions as a second elimination chamber. The second chamber 9 functions as a third elimination chamber. The third chamber 10 functions as a first elimination chamber. The fourth chamber 11 functions as a fourth elimination chamber as well as a resonance chamber.

The first chamber 8 has an inside volume of 2.2 liters. The second chamber 9 has an inside volume of 2.7 liters. The third chamber 10 has an inside volume of 2.7 liters. The fourth chamber 11 has an inside volume of 4.0 liters. The partition wall 5 is made of a punching plate having 15 small holes 12'. The partition wall 6 has a through hole 12 with diameter of 48.2 mm. The partition wall 7 has an open-end short pipe 13 inserted therethrough. This pipe 13 is 38.1 mm in diameter and 115 mm in axial length.

In order to introduce exhaust gases into the third chamber 10, an inlet pipe 14 is inserted from the end plate 3 to the partition wall 6 so that the inlet pipe 14 opens directly to the third chamber 10 beyond the first chamber 8 and the second chamber 9. The inlet pipe 14 has a plurality of small holes 15 and 16 at the portions which face and are located in the first chamber 8 and the second chamber 9, respectively. The holes 16 in the second chamber 9 are surrounded by a holder 38. There is provided a sound absorber 17 between the holder 38 and the inlet pipe 14. The inlet pipe is 48.9 mm in diameter and 197.5 mm in axial length. The plurality of small holes 15 consist of 50 holes of 3 mm diameter, which are arrayed 5 in the axial direction by 10 in the circumferential direction. The plurality of small holes 16 consist of 260 holes of 3 mm diameter, which are arrayed 10 in the axial direction by 26 in the circumferential direction.

In order to emit exhaust gases out of the main silencer 35, two outlet pipes 18 and 19 are inserted from the partition wall 5 to the end plate 4 so that the outlet pipes connect the first chamber 8 directlY to outside of the main silencer 35 beyond the second chamber 9, the third chamber 10 and the fourth chamber 11. The outlet pipe 18 has a plurality of small holes 21 and 23 at the portions which face and are located in the third chamber 10 and the fourth chamber 11, respectively. The outlet pipe 19 has a plurality of small holes 20 and 22 at the portions which face and are located in the third chamber 10 and the fourth chamber 11, respectively. The holes 22 and 23 in the fourth chamber 11 are surrounded by holders 39 and 40, respectively. There are provided sound absorbers 23 and 24 between the holder 40 and the outlet pipe 18 and between the holder 39 and the outlet pipe 19, respectively. The outlet pipes 18 and 19 are 29.4 mm in diameter and 620.0 mm in axial length. The plurality of small holes 20 and 21 consist of 45 holes of 3 mm diameter, which are arrayed 3 in the axial direction by 15 in the circumferential direction. The plurality of small holes 22 and 23 consist of 180 holes of 3 mm diameter, which arc arrayed 12 in the axial direction by 15 in the circumferential direction.

An explanation is provided for exhaust gas flow and sound elimination effect produced by the present invention. A part of exhaust gases introduced from the inlet pipe 14 goes through route a, whereby high frequency sound components of gases are lowered by the sound absorber 17 in the second chamber 9 or the sound absorbers 24, 25 in the fourth chamber 11, and all frequency sound components of gases are attenuated by being expanded in the second chamber 9 and the third chamber 10, and further high frequency sound components of gases are lowered by being filtered by the partition wall 5.

The other part of exhaust gases introduced from the inlet pipe 14 goes into the first chamber 8 through the small holes 15 along a route b, whereby high frequency sound components of gases are lowered, and further lowered by the sound absorbers 24, 25 in the fourth chamber 11. However, low frequency sound components remain without being attenuated. As a result, this structure produces comfortable sounds or sporty sounds which enhances low frequency sound components.

A part of the exhaust gases introduced into the third chamber 10 is emitted out of the main silencer 35 after passing through the plurality of small holes 20 and 21 into pipes 18 and 19, whereby high frequency sound components of exhaust gases are attenuated by the sound absorbers 24 and 25.

On the other hand, intermediate frequency sound components are enhanced by a resonance phenomenon caused in the outlet pipes 18 and 19 which have the plurality of small holes 20 and 21.

By tuning exhaust sounds based on a unique structural combination in accordance with the present invention, the magnitude of exhaust gases is lowered as a total and especially, high frequency sound components which are a main cause of noisy sounds are effectively attenuated so as to create comfortable sounds or sporty sounds.

Figure 6:
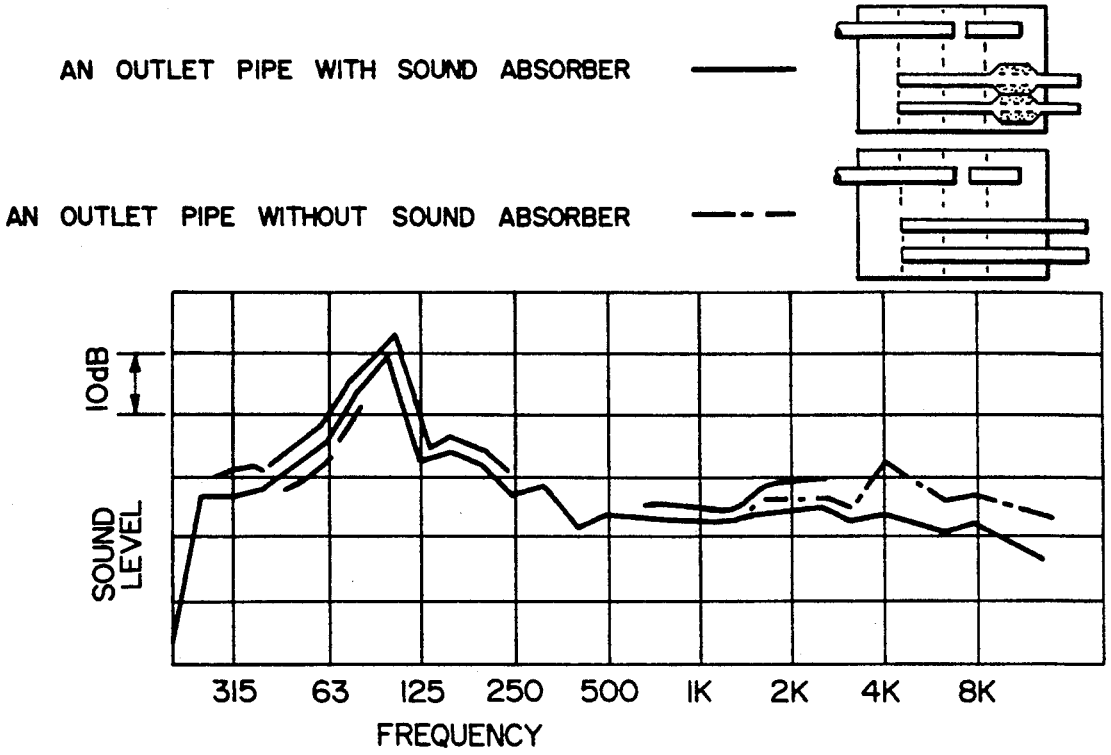
FIG. 6 shows an experimental comparison between an outlet pipe with glass wool and an outlet pipe without glass wool.

Referring now to FIGS. 6 to 10, the sound elimination effects in accordance with the present invention are experimentally shown. In FIG. 6, a sample which is equipped with the outlet pipes 18, 19 having the plurality of small holes 20, 21 in the fourth chamber 11 shows sound elimination effect in the high frequency sound region above 1.5 K Hz. A result shown by a dotted line is obtained by a reference sample which is equipped with outlet pipes having no holes.

Figure 7:
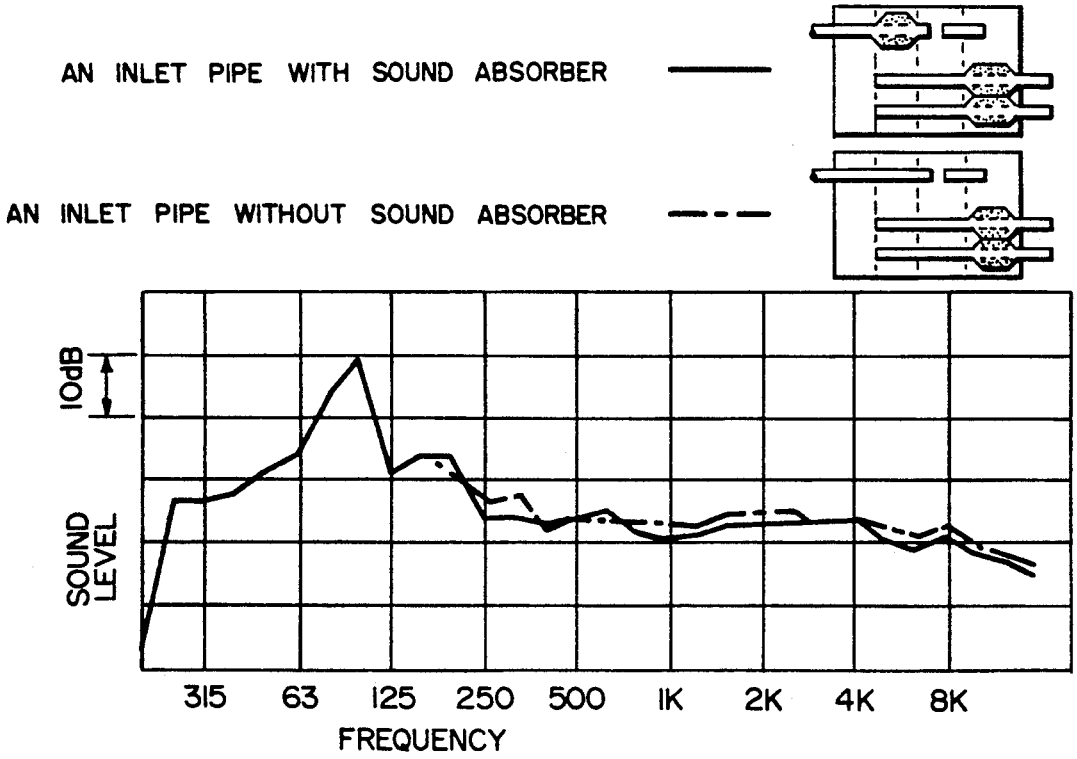
FIG. 7 shows an experimental comparison between an inlet pipe with glass wool and an inlet pipe without glass wool.

In FIG. 7, a sample which is equipped with the inlet pipe 14 having the plurality of small holes 16 and the sound absorber 17 surrounding the small holes 16 in the second chamber 9 shows sound elimination effect in the high frequency sound region above 700 Hz. A result shown by a dotted line is obtained by a reference sample which is equipped with an inlet pipe having no holes and no sound absorbers.

Figure 8:
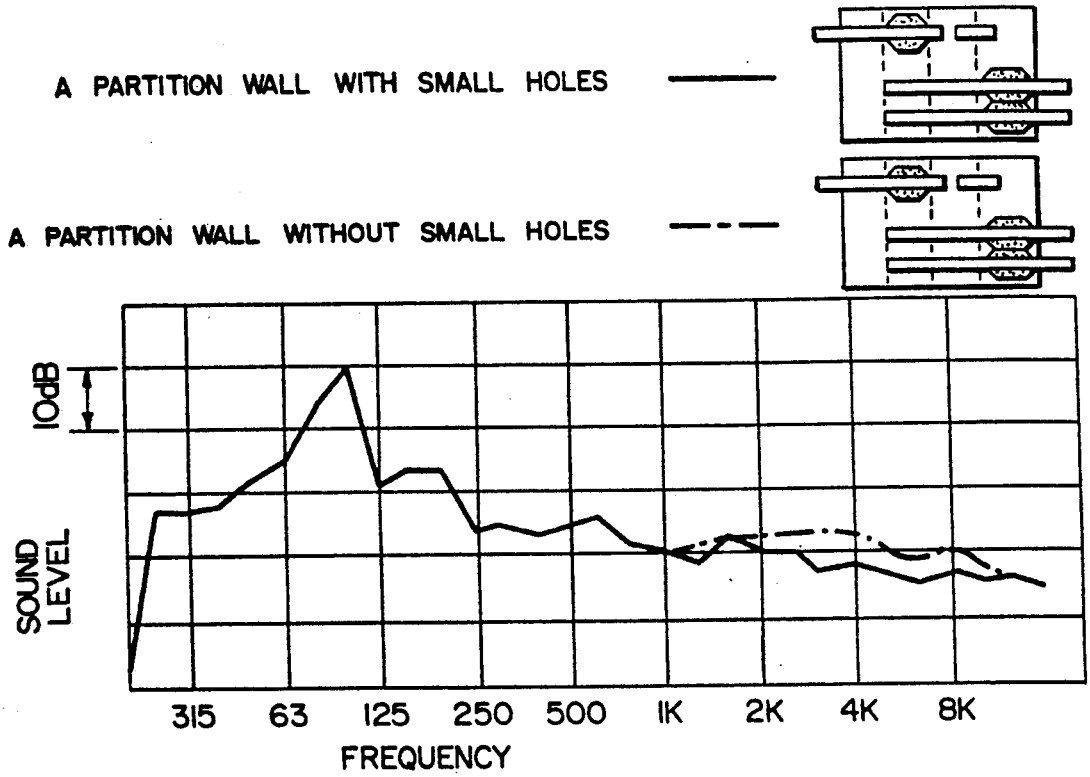
FIG. 8 shows an experimental comparison between a partition wall with a plurality of small holes and a partition wall without holes.

In FIG. 8, a sample which is equipped with the partition wall 5 having the plurality of small holes 12' shows sound elimination effect in the high frequency sound region above 1 K Hz. A result shown by a dotted line is obtained by a reference sample which is equipped with a partition wall having no holes.

Figure 9:
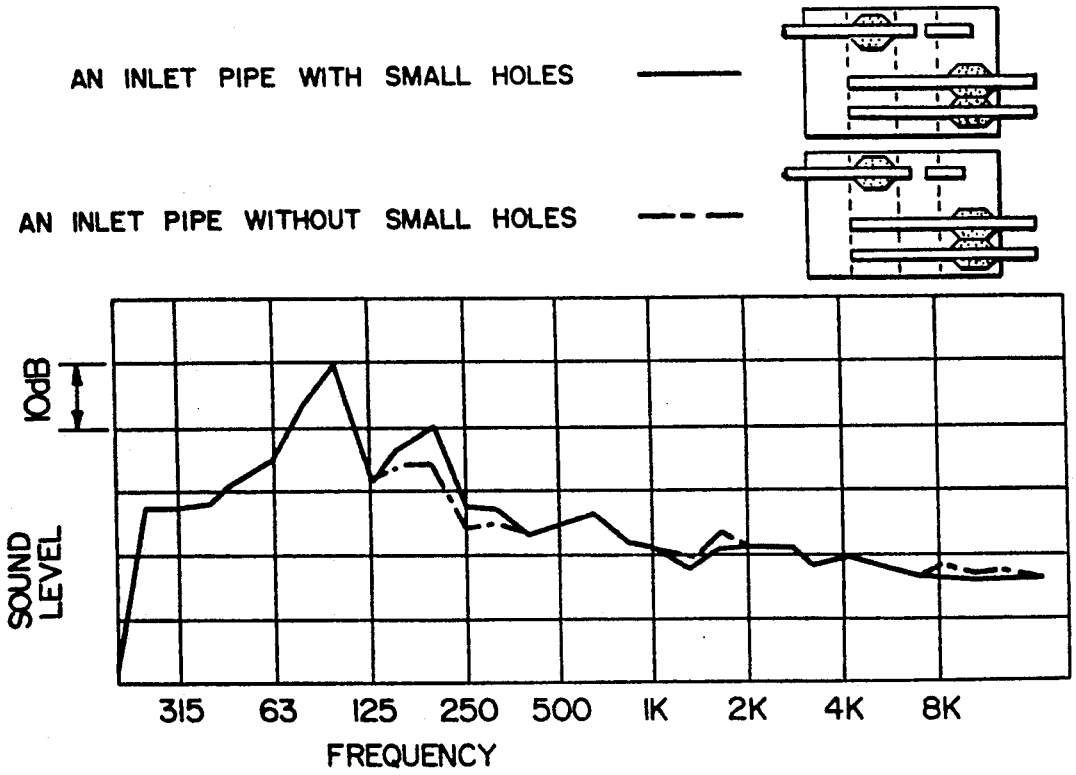
FIG. 9 shows an experimental comparison between an inlet pipe with small holes and an inlet pipe without holes.

In FIG. 9, a sample which is equipped with the inlet pipe 14 having the plurality of small holes 15 in the first chamber 8 shows sound enhancement effect in the lower frequency sound zone from 125 to 750 Hz. A result shown by a dotted line is obtained by a reference sample which is equipped with an inlet pipe having no holes.

Figure 10:
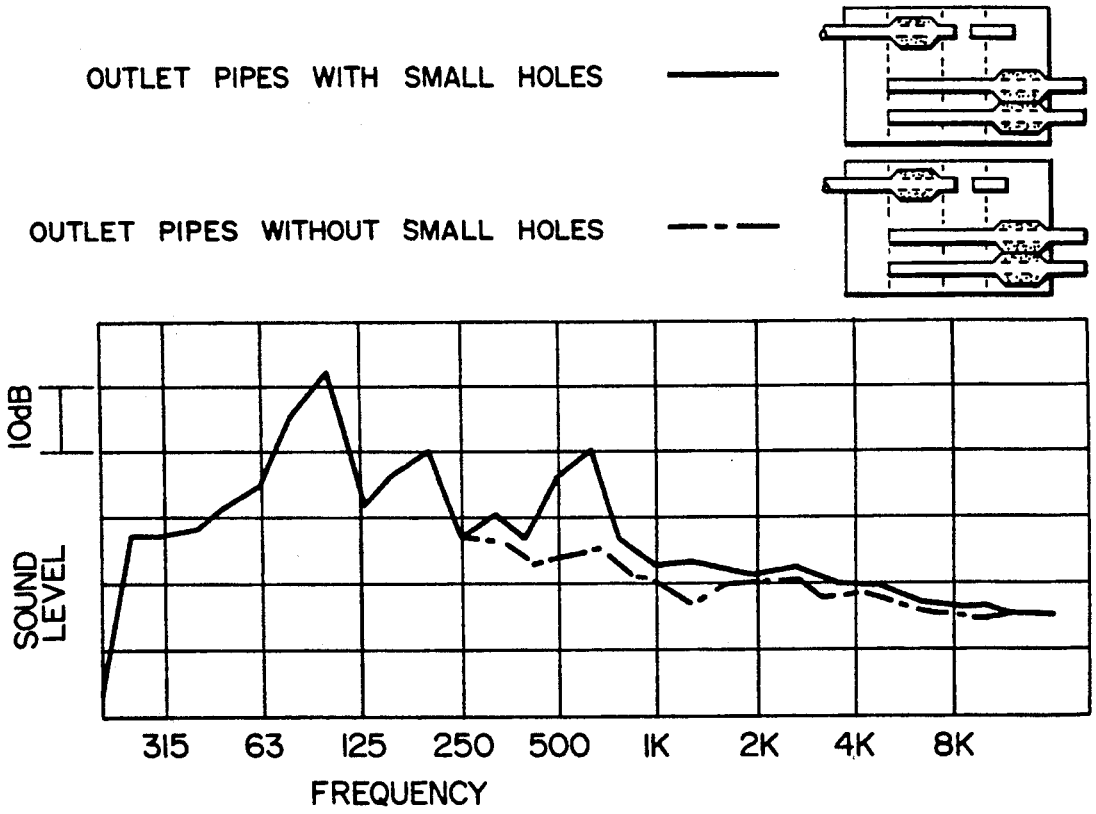
FIG. 10 shows an experimental comparison between an outlet pipe with small holes and an outlet pipe without holes.

In FIG. 10, a sample which is equipped with the outlet pipes 18, 19 having the plurality of small holes 20, 21 in the third chamber 10 shows sound enhancement effect in the intermediate frequency sound zone 250 to 2 K Hz. A result shown by a dotted line is obtained by a reference sample which is equipped with outlet pipes having no holes.

Figure 11:
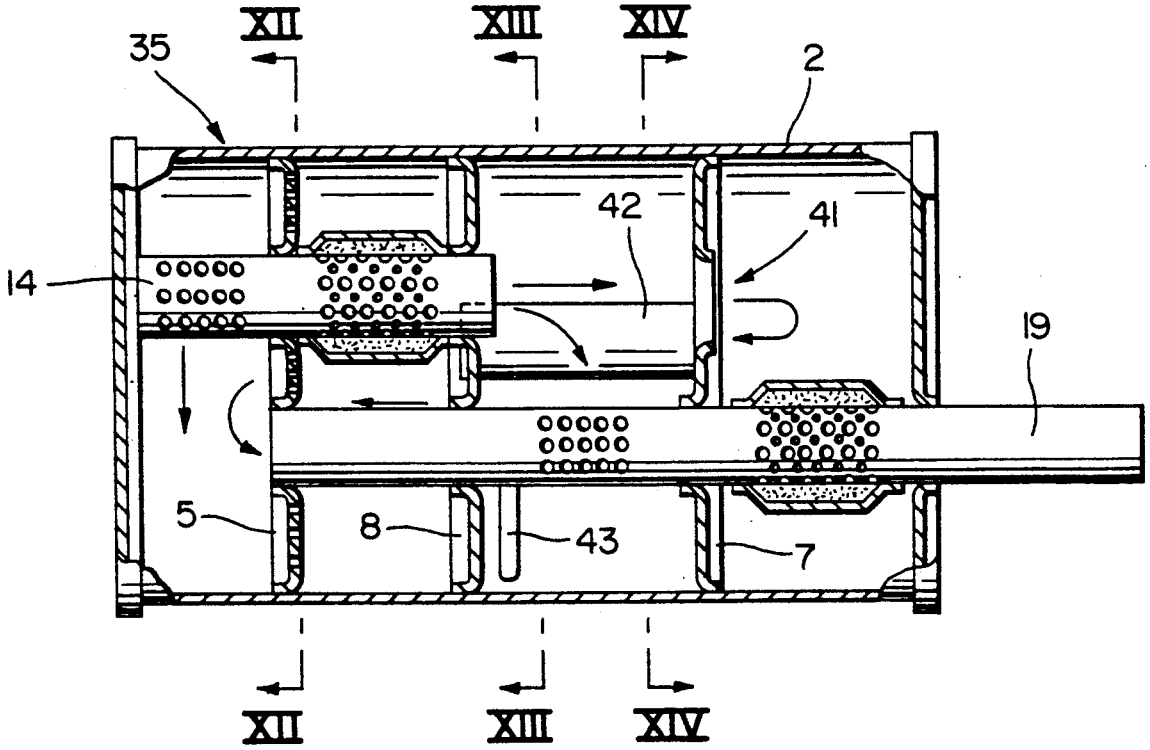
FIG. 11 is a view showing an interior structure of another silencer in accordance with the present invention.
Figure 11A:
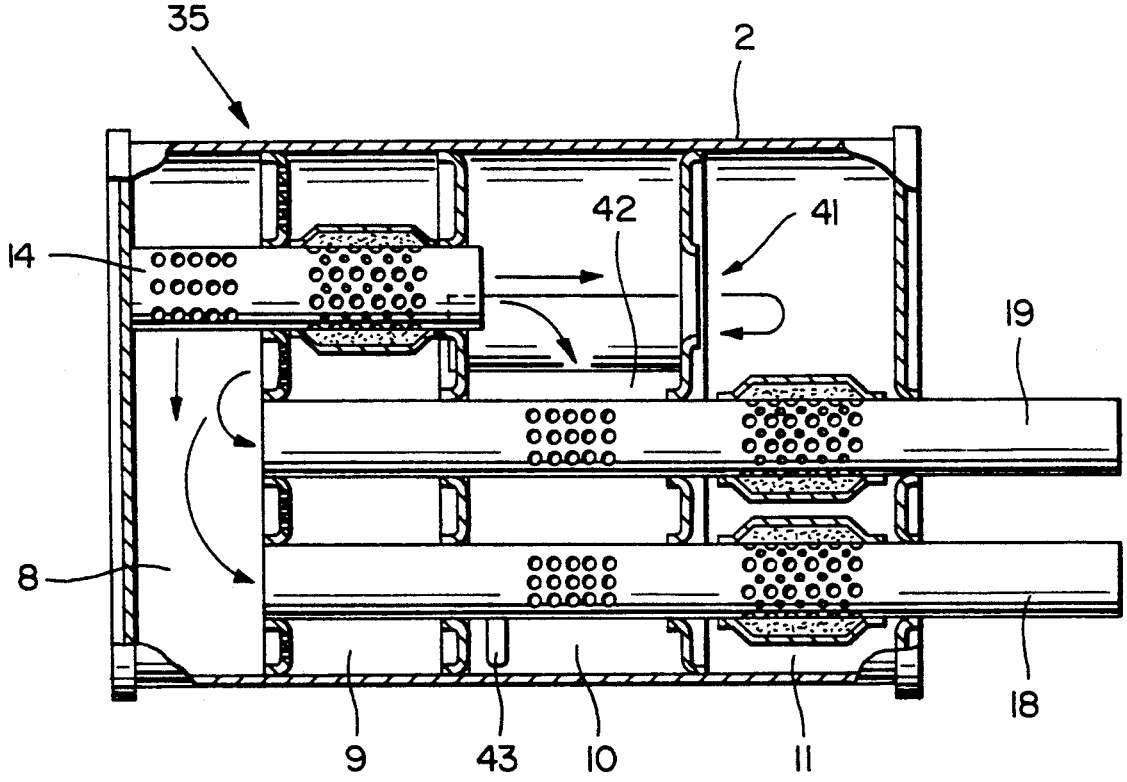
Figure 14:
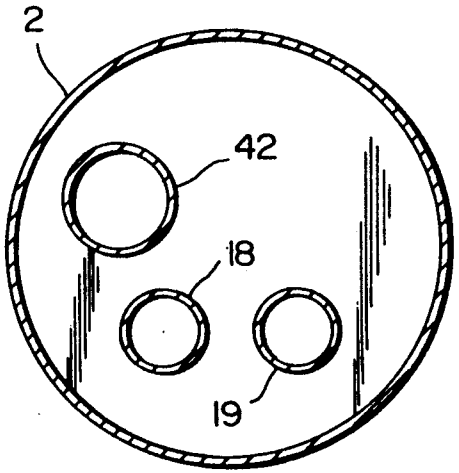
FIG. 14 is a cross-sectional view taken along line VIIII—VIIII in FIG. 11.
Figure 13:
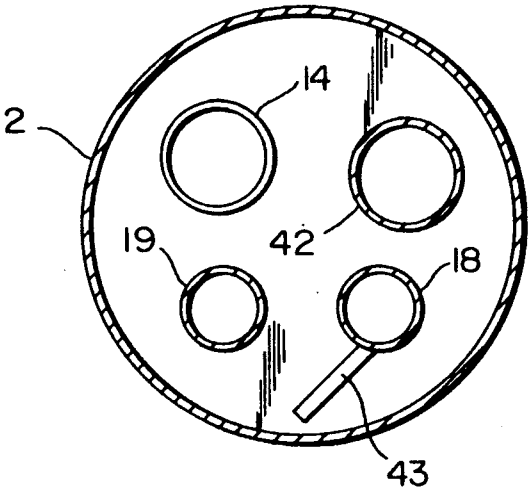
FIG. 13 is a cross-sectional view taken along line XIII—XIII in FIG. 11.
Figure 12:
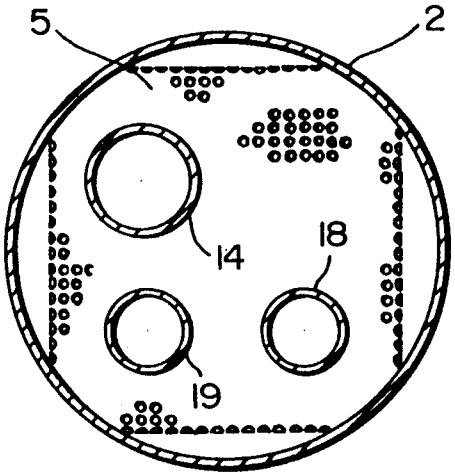
FIG. 12 is a cross-sectional view taken along line XII—XII in FIG. 11.

Though the present invention is explained based on the embodiment shown in FIG. 2, it can be applied to such an embodiment shown in FIG. In FIG. 11, 11-A, and 12 to 14. In FIG. 11, there is provided a hole 41 having a diameter of 50.8 mm on the partition wall 7. The second chamber 9 and the fourth chamber 11 are connected be means of a pipe 42 having a diameter of 48.6 mm so that the fourth chamber 11 can be used as an expansion chamber. Numeral 43 is a drain pipe for draining water collected in the silencer 35. By utilizing venturi effect, the drain pipe 43 can suck water collected in the bottom of the silencer 35 when exhaust gases are emitted through the outlet pipe 18.

We claim:

1. An engine exhaust apparatus comprising a silencer having:

a shell for accommodating silencer elements;

a front and a rear end plate closing both ends of the shell;

at least three partition walls to divide an inside space of the silencer into a plurality of chambers including a first chamber, a second chamber, a third chamber and a fourth chamber which are arrayed from front to rear of the silencer;

an inlet pipe bypassing the first and the second chambers, and connecting the front end plate and the third chamber;

said inlet pipe having a plurality of small holes located in the first and the second chambers;

said small holes of said inlet pipe located in the second chamber being surrounded by a first sound absorber;

an outlet pipe bypassing the second, the third and the fourth chambers, and connecting the first chamber and the rear end plate;

said outlet pipe having a plurality of small holes located in the third and the fourth chambers; and said small holes of said outlet pipe located in the fourth chamber being surrounded by a second sound absorber.

2. An engine exhaust apparatus in accordance with claim 1, wherein the plurality of chambers consists of four chambers.

3. An engine exhaust apparatus in accordance with claim 2, wherein the first, the second, the third and the fourth chambers are formed in series along an axis of the inlet pipe.

4. An engine exhaust apparatus in accordance with claim 2, wherein the first and the second sound absorber are held by holders.

5. An engine exhaust apparatus in accordance with claim 2, wherein the first chamber consists of a chamber for expanding exhaust gases.

6. An engine exhaust apparatus in accordance with claim 2, wherein the second chamber consists of a chamber for expanding exhaust gases.

7. An engine exhaust apparatus in accordance with claim 2, wherein the third chamber consists of a chamber for expanding exhaust gases.

8. An engine exhaust apparatus in accordance with claim 2, wherein the fourth chamber consists of a chamber for resonance.

9. An engine exhaust apparatus in accordance with claim 2, wherein the fourth chamber consists of a chamber for expanding exhaust gases.

10. An engine exhaust apparatus in accordance with claim 9, wherein the second chamber and the fourth chamber are connected by a pipe.

11. An engine exhaust apparatus in accordance with claim 9, wherein a through hole is provided in the partition wall between the third chamber and the fourth chamber.

12. An engine exhaust apparatus in accordance with claim 8, wherein a resonance pipe is provided in the partition plate between the third and the fourth chambers.

13. An engine exhaust apparatus in accordance with claim 12, wherein the resonance pipe has a same axis as the inlet pipe and is located downstream of the inlet pipe.

14. An engine exhaust apparatus in accordance with claim 1, wherein the inlet pipe is connected to the third chamber through the first and the second chambers.

15. An engine exhaust apparatus in accordance with claim 9, wherein the inlet pipe and the outlet pipe are extend parallel to each other.

16. An engine exhaust apparatus in accordance with claim 14, wherein the inlet pipe extends through the front end plate, the partition wall between the first chamber and the second chamber, and the partition wall between the second chamber and the third chamber.

17. An engine exhaust apparatus in accordance with claim 1, wherein the partition walls are three walls for defining four chambers in the shell.

18. An engine exhaust apparatus in accordance with claim 17, wherein the partition wall between the first chamber and the second chamber has a plurality of small holes.

19. An engine exhaust apparatus in accordance with claim 17, wherein the partition wall between the second and the third chambers has a through hole.

20. An engine exhaust apparatus in accordance with claim 17, wherein the partition wall between the third and the fourth chambers has a resonance pipe.

21. An engine exhaust apparatus in accordance with claim 17, wherein the partition wall between the third chamber and the fourth chamber has a hole.

22. An engine exhaust apparatus in accordance with claim 1, wherein the outlet pipe connects the first chamber to outside of the silencer through the second, the third and the fourth chambers.

23. An engine exhaust apparatus in accordance with claim 22, wherein the outlet pipe consists of a plurality of pipes which extend parallel to each other.

24. An engine exhaust apparatus in accordance with claim 22, wherein the outlet pipe has a drain pipe for sucking water collected in a bottom of the shell.

25. An engine exhaust apparatus in accordance with claim 22, wherein the outlet pipe is mounted in the rear end plate and three partition plates which define the first, the second, the third and the fourth chambers.

* * * * *